US007621765B1

(12) United States Patent
Wu

(10) Patent No.: US 7,621,765 B1
(45) Date of Patent: Nov. 24, 2009

(54) POWER ADAPTER WITH REPLACEABLE PLUG

(75) Inventor: Jui-Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/176,620

(22) Filed: Jul. 21, 2008

(51) Int. Cl.
*H01R 29/00* (2006.01)

(52) U.S. Cl. ..... 439/173

(58) Field of Classification Search ..... 439/173, 439/172, 218, 52, 53, 518, 131, 956
See application file for complete search history.

(56) References Cited

U.S. PATENT DOCUMENTS 5,848,907 A * 12/1998 Chen ..... 439/172
7,008,246 B2 * 3/2006 Zhuge ..... 439/173
7,265,517 B2 * 9/2007 Bumiller ..... 320/114
7,300,297 B1 * 11/2007 Wang ..... 439/173
2002/0127898 A1 * 9/2002 Liu ..... 439/131

* cited by examiner

*Primary Examiner*—Alexander Gilman
(74) *Attorney, Agent, or Firm*—Muncy, Geissler, Olds & Lowe, PLLC

(57) ABSTRACT

A power adapter includes a body and a plug. The body has a concave portion formed on a corner portion thereof, which includes a supporting wall, a blocking wall perpendicularly connected to the supporting wall and projecting a wedging portion, a base projecting from the supporting wall, a pair of ribs extending from the base, and a pair of grooves defined between the ribs and the supporting wall. The plug sliding in the concave portion has a hollow portion formed on a side surface thereof, into which the wedging portion engages, a receiving portion formed on a bottom surface thereof for receiving the base, a pair of guiding arms extending opposite inner side surface thereof and sliding in the grooves, and a pair of channels defined between the guiding arms and an inner bottom surface thereof, in which the ribs slide.

11 Claims, 3 Drawing Sheets

POWER ADAPTER WITH REPLACEABLE PLUG

BACKGROUND OF THE INVENTION

1. Field of the Invention

The invention relates to power an adapter and, more particularly pertains to an adapter capable of replacing different plugs adapting to different power sockets.

2. The Related Art

Electric products are conveniently used because they can be used in anywhere with a power socket. Generally, an electric product has only one kind of power plugs adapted to connect to a corresponding power socket for being supplied power. So far as electric products are concerned, various regions and countries in the world have their own power sockets.

Consequently, the electric products with only one kind of power plugs can not be used in different regions or countries. It is not convenient for the user to buy another electric product with a suitable power plug in different regions and countries.

SUMMARY OF THE INVENTION

An object of the present invention is to provide a power adapter with a body unit in a rectangular shape and a plug unit assembled with the body unit. The body unit has a concave portion formed on a corner portion thereof. The concave portion has a supporting wall and a blocking wall perpendicularly connected to the supporting wall.

The supporting wall projects a rectangular base having a pair of guiding walls perpendicular to the blocking wall. Each of the guiding walls extends a rib. Each of the ribs, each of the guiding walls and the supporting wall define a groove. The blocking wall has a notch portion from which an elastic wedging portion extends. The elastic wedging portion further projects from the blocking wall.

The plug unit has a top surface, a bottom surface is opposite to the top surface and a side surface is interconnected to the top surface and the bottom surface. The side surface has a hollow portion. The top surface has a slot connected to the hollow portion. The bottom surface has a rectangular receiving portion penetrating through the side surface. The receiving portion has an inner bottom surface parallel with the bottom surface, an inner blocking surface perpendicularly connected to the inner bottom surface, and a pair of inner side surfaces perpendicular connected to the inner bottom surface and the inner blocking surface.

Each of the inner side surface extends a guiding aim. Each of the guiding aim, each of the inner side surface and the inner bottom surface defines a channel.

While the plug unit is assembled with the body unit, the rib slides in the channel, the guiding arm slides in the groove, the bottom surface abuts against the supporting wall, the side surface abuts against the blocking wall, the hollow portion receives the elastic wedging portion, and the elastic wedging portion engages into the slot.

Therefore, the plug unit is guided to slide in and apart from the concave portion of the body unit. While the power adapter is in use, the elastic wedging portion of the body unit engages into the slot of the plug unit to prevent the plug unit from being apart form the body unit.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
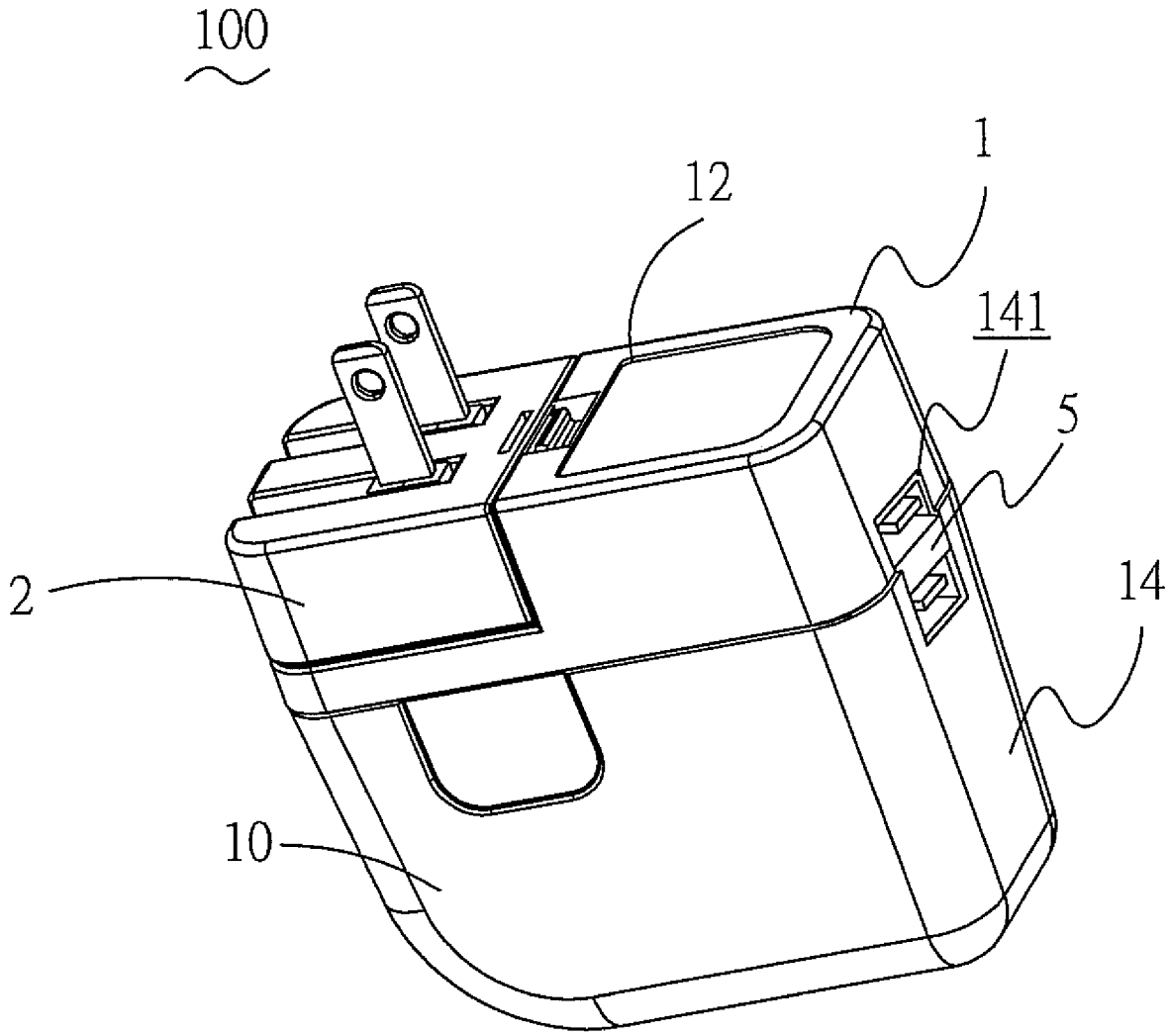
FIG. 1 is a perspective view showing a power adapter of assembled a body and a plug according to the present invention.
Figure 2:
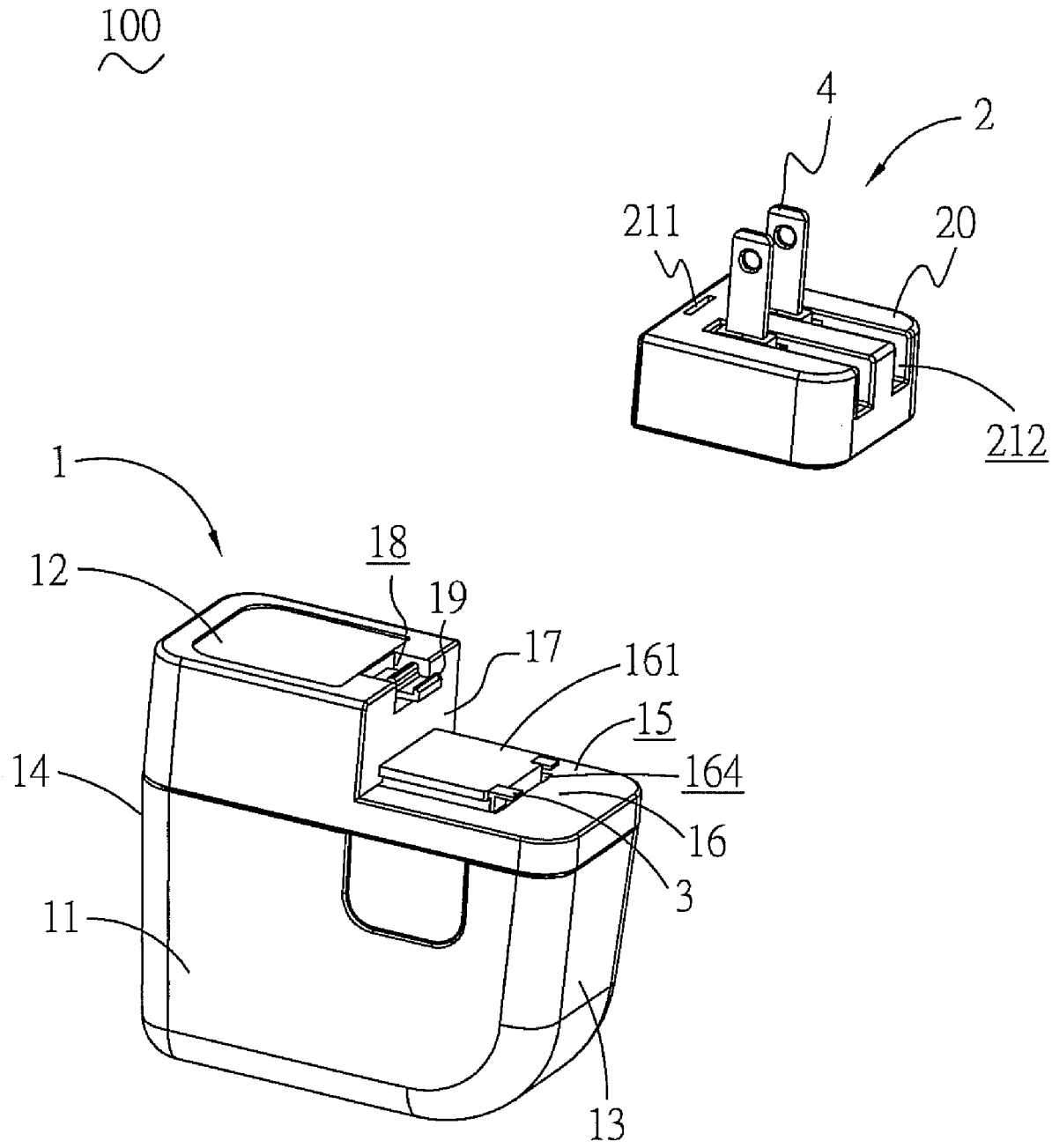
FIG. 2 is a perspective view showing a power adapter of separated the body and the plug according to the present invention.

Please refer to FIG. 1 and FIG. 2, an exemplary embodiment of a power adapter 100 having a body unit 1 and a plug unit 2 is shown. The body unit 1 defines a first sidewall 10, a second sidewall 11 parallel to the first sidewall 10, a third sidewall 12 perpendicularly interconnected between the first sidewall 10 and the second sidewall 11, a fourth sidewall 13 perpendicularly connected to the first sidewall 10, the second sidewall 11 and the third sidewall 12, and a fifth sidewall 14 perpendicularly connected to the first sidewall 10, the second sidewall 11 and the third sidewall 12, and parallel to the fourth sidewall 13.

The first sidewall 10, the second sidewall 11, the third sidewall 12, the fourth sidewall 13 and the fifth sidewall 14 define a receiving space inside the body unit 1 for receiving a converting circuit (not shown in figures). The fifth sidewall 14 is formed a penetrating opening 141 for receiving a connector 5 connected to an electronic product (not shown in figures). Specially, the connector 5 is an universal serial bus connector (USB).

A corner portion which the third sidewall 12 connects to the fourth sidewall 13 is formed a concave portion 15 penetrating the first sidewall 10 and the second sidewall 11. The concave portion 15 consists of a supporting wall 16 and a blocking wall 17 perpendicularly connected to the supporting wall 16. The supporting wall 16 perpendicularly connects to the first sidewall 10, the second sidewall 11 and the fourth side wall 13. The blocking wall 17 perpendicularly connects to the first sidewall 10, the second sidewall 11 and the third sidewall 12.

Figure 3:
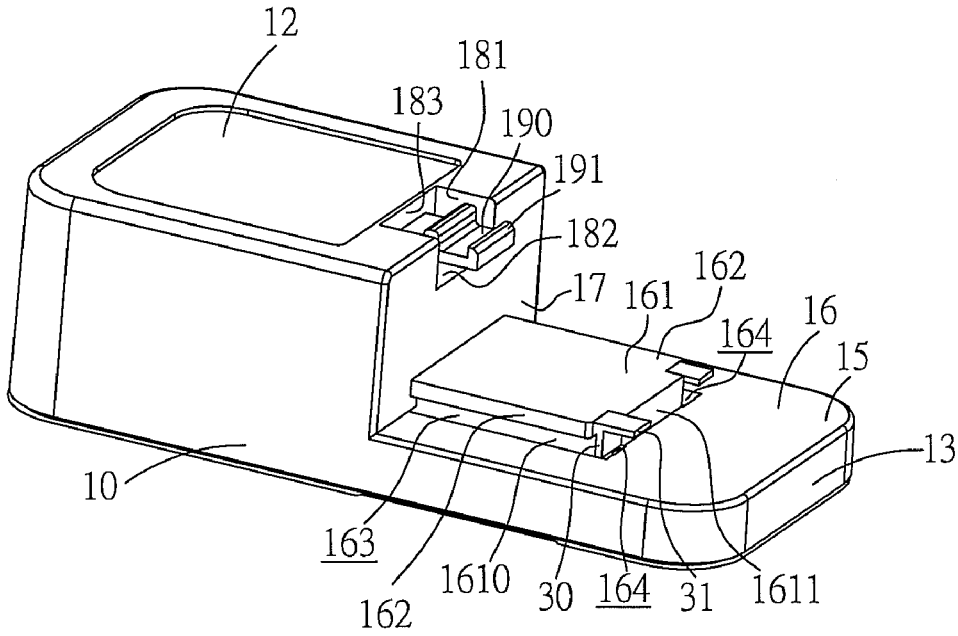
FIG. 3 is a partial view showing the body according to the present invention.

Please refer to FIG. 2 and FIG. 3. The supporting wall 16 projects a rectangular base 161 in a central area thereof. The rectangular base 161 has a pair of guiding walls 1610 (only one shown in figures) parallel to the first sidewall 10 and the second sidewall 11, a connecting wall (obstructed by the blocking wall) perpendicularly connected to the guiding walls 1610 and the blocking wall 17, and a mating wall 1611 opposite to the connecting wall and connected to the guiding walls 1610.

The pair of guiding walls 1610 extend a pair of ribs 162 which extend towards the first sidewall 10 and the second sidewall 11 respectively. A pair of grooves 163 is defined by the pair of ribs 162, the pair of guiding walls 1610 and the supporting wall 16. The supporting wall 16 is formed a pair of penetrating holes 164 adjacent to opposite end portions of the mating wall 1611 of the rectangular base 161 respectively.

Each of the penetrating holes 164 receives a contact 3. The contact 3 consists of a linking portion 30 and a contacting portion 31 connected to the linking portion 30. One end of the linking portion 30 electronically connects to the converting circuit (not shown in figures) received in the body unit 1. The other end of the linking portion 30 passes through the penetrating hole 164 and projects from the supporting wall 16. The free end of the other end of the linking portion 30 perpendicularly extends the contacting portion 31 extending towards the fourth sidewall 13.

A corner portion which the third sidewall 12 connects to the blocking wall 17 forms a notch portion 18. The notch portion 18 consists of a pair of inner sidewalls 181 (only one shown in figures), an inner bottom wall 182 perpendicularly interconnected to the inner sidewalls 181, and an inner blocking wall 183 perpendicularly connected to the inner sidewalls 181 and the inner bottom wall 182.

The inner blocking wall 183 of the notch portion 18 extends an elastic wedging portion 19. The elastic wedging portion 19 has an elastic board 190 and a wedging piece 191 connected to the elastic board 190. The elastic board 190 extends from the inner blocking wall 183 of the notch portion 18 and projects from the blocking wall 17, which is apart from the inner sidewalls 181 and the inner bottom wall 182. The elastic wedging piece 191 perpendicularly extends from the free end of the elastic board 190 and towards the third sidewall 12.

Figure 4:
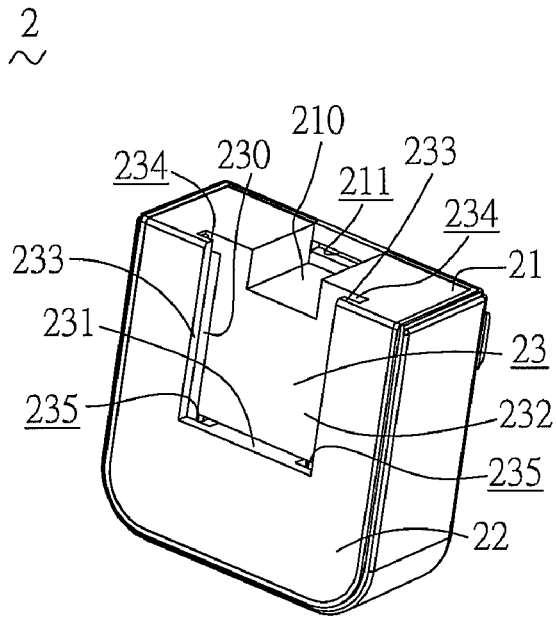
FIG. 4 is a perspective view showing the plug according to the present invention.

Please refer to FIG. 2 and FIG. 4. The plug 2 has a top surface 20, a side surface 21, and a bottom surface 22 parallel to the top surface 20. The side surface 21 perpendicularly interconnects to the top surface 20 and the bottom surface 22.

The side surface 21 of the plug 2 forms a hollow portion 210. The top surface 21 of the plug 2 forms a slot 211 connected to the hollow portion 210, and a pair of blade receiving portions 212 receiving a pair of blades 4. The bottom surface 22 of the plug 2 forms a receiving portion 23 connected to the hollow portion 210 and penetrating through the side surface 21.

The receiving portion 23 consists of a pair of inner side surfaces 230 (only one shown in figures), an inner blocking surface 231 perpendicularly interconnected to the inner side surface 230 and an inner bottom surface 232 perpendicularly connected to the inner side surfaces 230 and the inner blocking surface 231. Each of the inner side surfaces 230 forms a guiding aim 233 at the same level with the bottom surface 22.

A pair of channels 234 is defined by the inner side surfaces 230, the guiding arms 233 and the inner bottom surface 232. A pair of apertures 235 is formed on opposite end portions of the inner blocking surface 231 respectively. Specially, the apertures 235 penetrate through the inner blocking surface 231.

While the body unit 1 and the plug unit 2 are assembled, the ribs 162 of the rectangular base 161 of the body unit 1 slide into the channels 234 of the receiving portion 23 of the plug unit 2, and the guiding arms 233 of the plug unit 2 slide into the grooves of the body unit 1. At the same time, the elastic board 190 of the elastic wedging portion 19 is supplied an external force to bend towards the inner bottom wall 182 of the notch portion 18.

While the side surface 21 of the plug unit 2 abuts against the blocking wall 17 of the body unit 1, the plug unit is completely positioned in the concave portion 15 of the body unit 1. The elastic board 190 of the elastic wedging portion 19 is positioned into the hollow portion 210 of the plug unit 2 and is restored to original position.

Therefore, the wedging piece 191 of the elastic wedging portion 19 of the body unit 1 engages into the slot 211 of the plug unit 2. The connecting portions 31 of the pair of the contacts 3 insert into the pair of apertures 235 of the plug unit 2, and electronically connect the pair of the blades 4 respectively.

While the blades 4 of the plug unit 2 insert into a corresponding power sockets (not shown in figures), an external alternating current is transmitted through the blades 4 and the contacts 3 to the converting circuit in the body unit 1 and then is converted to a direct current which is supplied to the electric product through the connector 5 in the penetrating hole 141 of the body unit.

While the plug unit 2 is apart from the body unit 1 for being replaced another one, the elastic board 190 of the elastic wedging portion 19 is applied the external force to bend towards the inner bottom wall 182 of the concave portion 18. Therefore, the wedging piece 191 is apart from the slot 211 of the plug unit 2 and then the ribs 162 of the body unit 1 slide out from the channels 234 of the plug unit 2, and the guiding arms 233 of the plug unit 2 slide out from the grooves of the body unit 1.

The plug unit 2 is guided to slide in and apart from the concave portion 15 of the body unit 1 by the ribs 162 of the body unit 1 slide along the channels 234 of the plug unit 2, and the guiding arms 233 of the plug unit 2 slide along the grooves of the body unit 1. While the power adapter 100 is in use, the wedging piece 191 of the wedging portion 19 of the body unit 1 engages into the slot 211 of the plug unit 2 to prevent the plug unit 2 from being apart from the body unit 1.

Furthermore, the present invention is not limited to the embodiments described above; various additions, alterations and the like may be made within the scope of the present invention by a person skilled in the art. For example, respective embodiments may be appropriately combined.

What is claimed is:

1. A power adapter, comprising:

a body unit having:

a concave portion formed in said body unit, the concave portion having a supporting wall and a blocking wall connected to said supporting wall, a first guiding portion formed on the supporting wall, and at least two contacts each having a contacting portion extending into said concave portion; and a plug unit adapted to be slidably received in said concave portion of said body unit, the plug unit having:

a top surface, a bottom surface opposite to said top surface and abutted against said supporting wall of said body unit, a side surface interconnected to said top surface and said bottom surface and abutted against said blocking wall of said body unit, a second guiding portion formed on said bottom surface for engaging with said first guiding portion of said body unit to guide said plug unit to slide in said concave portion, at least two blades disposed on said top surface, and at least two apertures defined in said plug unit, said contacts extending through the corresponding apertures to electrically connect said blades;

wherein said blocking wall of said body unit and said side surface of said plug unit form a locking means comprising an elastic wedging portion and a hollow portion for engaging with the elastic wedging portion to lock said body unit and said plug unit together;

wherein the first guiding portion comprises a base of substantially rectangular shape formed on said supporting wall, and the second guiding portion comprises a receiving portion of substantially rectangular shape formed in said bottom surface and exposing to said side surface for receiving said base;

wherein the first guiding portion further comprises:

a pair of ribs extending from two opposite sides of the rectangular base and substantially perpendicular to said blocking wall, and a pair of grooves defined by said ribs, said sides of the base and said supporting wall; and wherein said receiving portion comprises:

an inner bottom surface recessed in said bottom surface and substantially parallel with said bottom surface, a pair of inner side surfaces substantially perpendicularly connected to said inner bottom surface, an inner blocking surface substantially perpendicularly connected to said inner side surfaces and said inner bottom surface, a pair of guiding arms extending inward from said inner side surfaces and sliding in said grooves of said body unit respectively, and a pair of channels defined by said inner side surfaces, said guiding arms and said inner bottom surface, said ribs of said body unit sliding in said channels respectively.

2. The power adapter as claimed in claim 1, wherein the elastic wedging portion projects from said blocking wall and extending into the concave portion, the hollow portion is formed in said side surface of said plug unit for receiving said elastic wedging portion of said body unit.

3. The power adapter as claimed in claim 2, wherein the elastic wedging portion has a wedging piece, and a slot is formed in said top surface of said plug unit and communicates with said hollow portion for engaging with said wedging piece.

4. The power adapter as claimed in claim 3, wherein a notch portion is formed in said blocking wall, said elastic wedging portion of said body unit has an elastic board extending from said notch portion and is received in said hollow portion of said plug unit, and said wedging piece substantially perpendicularly extends from said elastic board.

5. The power adapter as claimed in claim 4, wherein said notch portion has a inner blocking wall substantially parallel to said blocking wall, a pair of inner sidewall substantially perpendicularly connected to said inner blocking wall, and a inner bottom wall substantially perpendicularly connected to said inner blocking wall and said inner sidewalls.

6. The power adapter as claimed in claim 5, wherein said elastic board of said elastic wedging portion extends from said inner blocking wall and is apart from said inner sidewalls and said inner bottom wall of said notch portion.

7. The power adapter as claimed in claim 1, wherein a pair of blade receiving portions is formed in said top surface of said plug unit, and the pair of blades is rotatably folded in or unfolded from said blade receiving portions.

8. A body unit of a power adapter, comprising:

a concave portion adapted for slidably receiving a plug unit, the concave portion having a supporting wall and a blocking wall connected to said supporting wall;

a base formed on said supporting wall, opposite sides of the base respectively forming a guiding means;

an elastic wedging portion projecting from said blocking wall and extending into the concave portion; and at least two contacts each having a contacting portion extending into said concave portion for electrically connecting said plug unit;

wherein a notch portion is formed in said blocking wall and said elastic wedging portion has an elastic board extending from said notch portion and a wedging piece substantially perpendicularly extending from said elastic board; and wherein said notch portion has a inner blocking wall substantially parallel to said blocking wall, a pair of inner sidewall substantially perpendicularly connected to said inner blocking wall, and a inner bottom wall substantially perpendicularly connected to said inner blocking wall and said inner sidewalls, said elastic board of said elastic wedging portion extends from said inner blocking wall and is apart from said inner sidewalls and said inner bottom wall of said notch portion.

9. The body unit as claimed in claim 8, wherein the base is of rectangular shape, and the guiding means comprises:

a pair of ribs extending from two opposite sides of the rectangular base and substantially perpendicular to said blocking wall, and a pair of grooves defined by said ribs, said sides of the base and said supporting wall.

10. A plug unit of a power adapter, comprising:

a top surface;

a bottom surface opposite to said top surface;

a side surface interconnected to said top surface and said bottom surface;

at least two blades disposed on said top surface;

a receiving portion formed in said bottom surface and exposing to said side surface; and a hollow portion formed in said side surface;

wherein said receiving portion comprises:

an inner bottom surface recessed in said bottom surface and substantially parallel with said bottom surface, a pair of inner side surfaces substantially perpendicularly connected to said inner bottom surface, an inner blocking surface substantially perpendicularly connected to said inner side surfaces and said inner bottom surface, a pair of guiding arms extending inward from said inner side surfaces, and a pair of channels defined by said inner side surfaces, said guiding arms and said inner bottom surface;

wherein a slot is formed in said top surface and communicates with said hollow portion.

11. The plug unit as claimed in claim 10, wherein a pair of blade receiving portions is formed in said top surface, and the pair of blades is rotatably folded in or unfolded from said blade receiving portions.

* * * * *